United States Patent [19]

Betts

[11] 4,438,639

[45] Mar. 27, 1984

[54] PRESSER FOOT FOR A KNITTING MACHINE

[75] Inventor: Max W. Betts, Coventry, England

[73] Assignee: Courtaulds Limited, London, England

[21] Appl. No.: 348,357

[22] Filed: Feb. 12, 1982

[30] Foreign Application Priority Data

Feb. 17, 1981 [GB] United Kingdom ..... 8104943

[51] Int. Cl.[3] ..... D04B 7/04

[52] U.S. Cl. ..... 66/64

[58] Field of Search ..... 66/60 H, 64 R, 60

[56] References Cited

U.S. PATENT DOCUMENTS 3,049,900 8/1962 Bräm ..... 66/60

3,153,922 10/1964 Bräm ..... 60/64

FOREIGN PATENT DOCUMENTS 1288043 9/1972 United Kingdom ..... 66/64

*Primary Examiner*—Ronald Feldbaum

*Attorney, Agent, or Firm*—Howson and Howson

[57] ABSTRACT

A presser foot, for a knitting machine having independently operable needles located in opposed needle beds, has a leading portion and a trailing portion extending rearwardly from the leading portion. The leading portion comprises a member with a smooth surface adapted to contact knitted loops when the presser foot is in use, the forward part of this smooth surface being higher than the rearward part and the two parts having a smooth transition between them. This member is adapted to resist deformation by the forces applied by knitted loops and is so shaped that the inclination of the forward part of said smooth surface which first contacts the knitted loops during relative movement of machine needles and presser foot, in use, is inclined to the direction of said relative movement at an angle less than 35°. The trailing portion of the presser foot, at the location where it departs from the leading portion, is at a level substantially the same as or higher than the level of the rearmost stitch-contacting section of said leading portion. The trailing portion is adapted to be resiliently deflected in an upward direction by the forces applied to it, in use, by knitted loops.

7 Claims, 10 Drawing Figures

PRESSER FOOT FOR A KNITTING MACHINE

Figure 1:
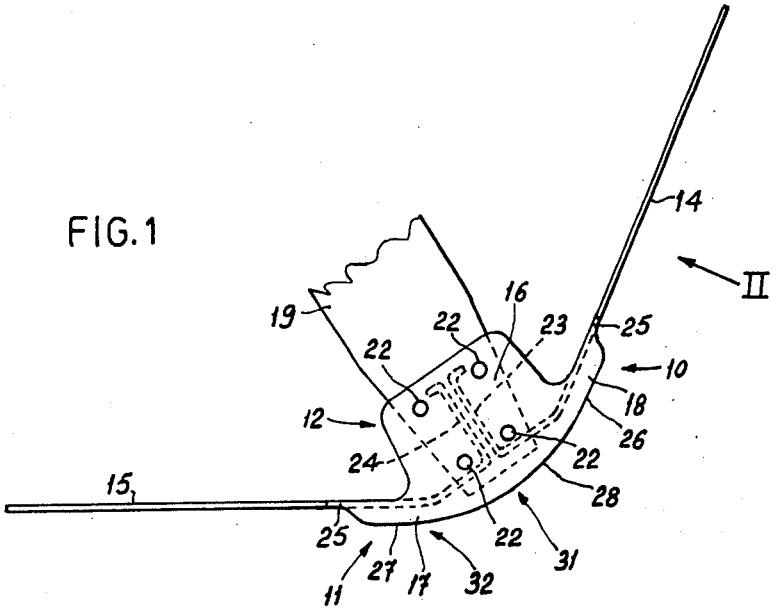

This invention relates to a presser foot device for a knitting machine.

In the conventional knitting machine in commercial use at present, the knitted fabric is pulled down away from the needles by means of nip rollers between which the fabric passes and the "roller take-down" as it is called, exerts on the knitted fabric, and thus on the loops held on the needles, the tension required to enable the knitting action of the needles to be carried out satisfactorily.

Recently, there have been introduced, for example by Messrs. Edouard Dubied & Cie, S.A. of Switzerland, flat V-bed knitting machines which can be operated without roller take-down. One such machine is the Dubied JDR-PM. Flat machines of this kind are fitted with a presser foot which is an element extending, in its operational position, longitudinally of and between the needle beds, approximately at the level of the knocking-over bits, in the region of the active needles.

In the JDR-PM machine, four presser feet are carried on the cam carriage of the knitting machine. The presser feet are arranged in pairs, each pair being associated with one of the cam systems of this double-system machine, and one presser foot of each pair is arranged to be in an operational position in relation to the needles of the machine, during movement of the cam carriage in one direction along the needle beds, the other presser foot of each pair being operational during the return movement of the carriage.

The function of the presser foot is to hold down the loops of the knitted fabric when the needles rise to take more yarn, and thereby to allow the knitting action to proceed without any need to exert tension on the fabric from below.

One form of presser foot device is disclosed in British Pat. Specification No. 1,288,043. In that device, a supporting member extends downwardly from a presser foot carrier, two presser feet are mounted on the lower end of the supporting member and project away from each other in substantially opposite directions, and the supporting member is movably mounted on the carrier so as to be movable to bring one of the two presser feet into an operative position, for movement of the carrier in one direction along the needle beds and to bring the other presser foot into an operative position for movement of the carrier in the opposite direction along the needle beds. The presser foot carrier is arranged to carry the supporting member and the presser feet along the needle beds in synchronism with the activation of the needles and the presser feet are so located that the operative presser foot will hold down the loops on the needles as the needles rise.

The presser feet described in British Patent Specification No. 1,288,043 each comprise a single element which is of uniform cross-section along its length. It has now been found that a presser foot having a form different from that of a uniform cross-section may have advantages in knitting some yarns and some stitch structures.

The present presser foot may be used in a flat V-bed knitting machine and may be mounted on a downwardly extending supporting member in a similar way to the presser feet described in British Patent Specification No. 1,288,043. Preferably the supporting member includes an arrangement allowing the presser foot to ride up against the action of a spring under the influence of forces exerted on the presser foot by the knitting loops. Such an arrangement is described in Belgian Patent Specification No. 861,059.

The presser foot according to the present invention is not limited in its use to flat V-bed knitting machines and may also be used in circular knitting machines.

According to the invention, a presser foot for a knitting machine having independently operable needles located in opposed needle beds, having a leading portion and a trailing portion extending rearwardly from the leading portion, is characterised in that the leading portion comprises a member with a smooth surface adapted to contact knitted loops when the presser foot is in use, the forward part of said surface being higher than the rearward part and the two parts having a smooth transition between them, said member being adapted to resist deformation by the forces applied by knitted loops and being so shaped that the forward part of said surface which first contacts the knitted loops during relative movement of machine needles and presser foot, in use, is inclined to the direction of said relative movement at an angle less than 35°, and in that said trailing portion, at the location where it departs from the leading portion, is at a level substantially the same as or higher than the level of the rearmost stitch-contacting section of said leading portion, the trailing portion being adapted to be resiliently deflected in an upward direction by the force applied to it, in use, by knitted loops.

The terms "leading", "forward", "rearward" and "rearmost", when used in this specification in connection with the parts of a presser foot are intended to refer to the spatial dispositions of those parts in relation to the relative direction of movement between the presser foot and the needles of a knitting machine in which the presser foot is fitted, when the presser foot is in use. The terms "higher" and "lower", when used in this specification in connection with elements of a knitting machine are used, unless the context demands otherwise, in the sense that when needles are moved to rise and gather yarn they move from a lower to a higher level in the machine irrespective of the attitude of the machine, or the needles in relation to the vertical.

Said member comprising the leading portion of the presser foot according to the invention may comprise two spaced elements each having a lower edge, said lower edges constituting a smooth surface as defined above and each of said elements may be of plate-like form.

Said smooth surface may be straight or curved. For example, it may have a profile which is part of a circle with a radius which is large in relation to the bed spacing of a knitting machine giving the surface a gently curving arcuate form.

The said trailing portion may comprise a thin elongate element, for example a resilient wire or rod which may be of circular cross-section. The trailing element may extend rearwardly from a location in the region of the flush jack position to a location in the region where the needles descent again to the flush jack height, said trailing element having a protuberant portion intended to be located in the region of the descending path of the needles, between the location at which the needles are in their highest position and the location where the needles take new yarn into their hooks, said protuberant portion serving to tension yarn extending between the opposed needle beds so that the loops of yarn on the needle shanks are held close to the shanks and are less likely to be impaled by the latches of the descending needles.

However, a protuberant portion carried on a trailing element of a presser foot may be advantageous even when used in conjunction with a leading portion of a presser foot different from that described above. Thus, according to another aspect of the invention, a presser foot for a knitting machine having independently operable needles located in opposed needle beds comprises a thin elongate trailing element extending rearwardly from a leading portion of the presser foot, from a location in the region of the flush jack position to a location in the region where the needles descend again to the flush jack height, said trailing element having a protuberant portion located in the region of the descending path of the needles between the location at which the needles are in their highest position and the location where the needles take new yarn into their hooks, said protuberant portion serving to tension yarn extending between the opposed needle beds so that the loops of yarn on the needle shanks are held close to the shanks and are less likely to be impaled by the latches of the descending needles.

Preferably, said protuberant portion terminates in advance of the location where the latch spoon enters between knocking over bits of the machine. Advantageously, the protuberant portion protrudes in three dimensions and it may be constituted by a tube through which said trailing element extends. If the trailing element is constituted by a metal wire, the tube may be a metal tube soldered to the wire so that the join between the two is a smoothly curved transition.

The invention also includes a knitting machine fitted with a presser foot as defined above.

Figure 2:
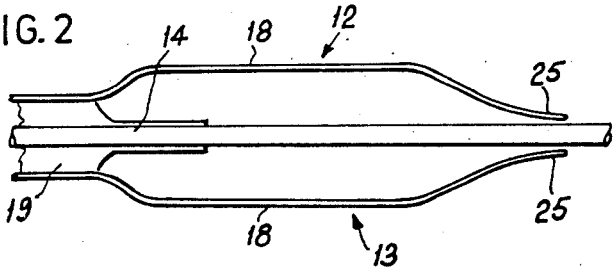
Figure 7:
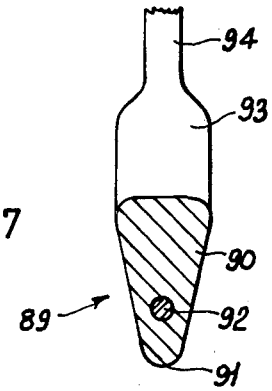
Figure 3:
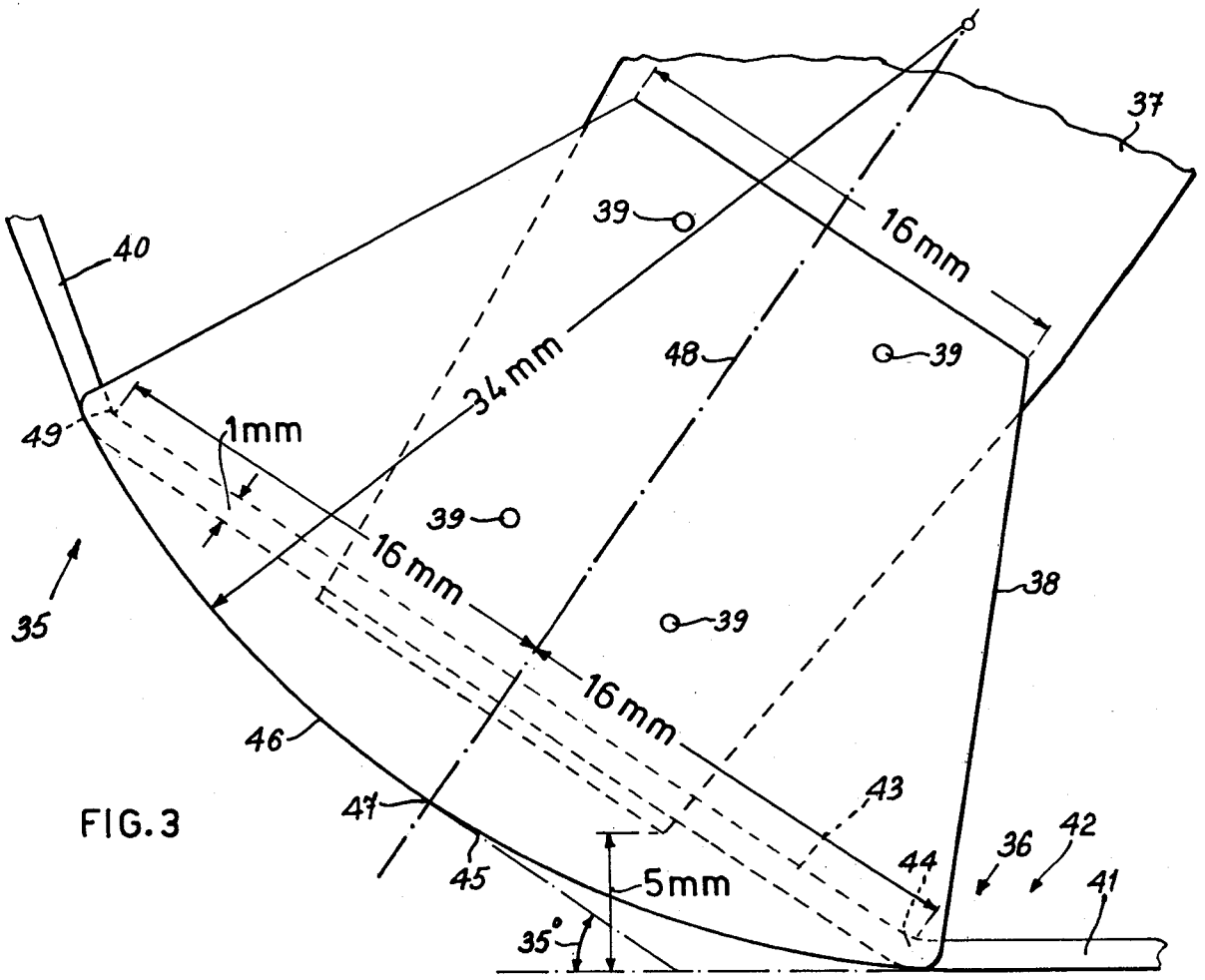
Figure 4:
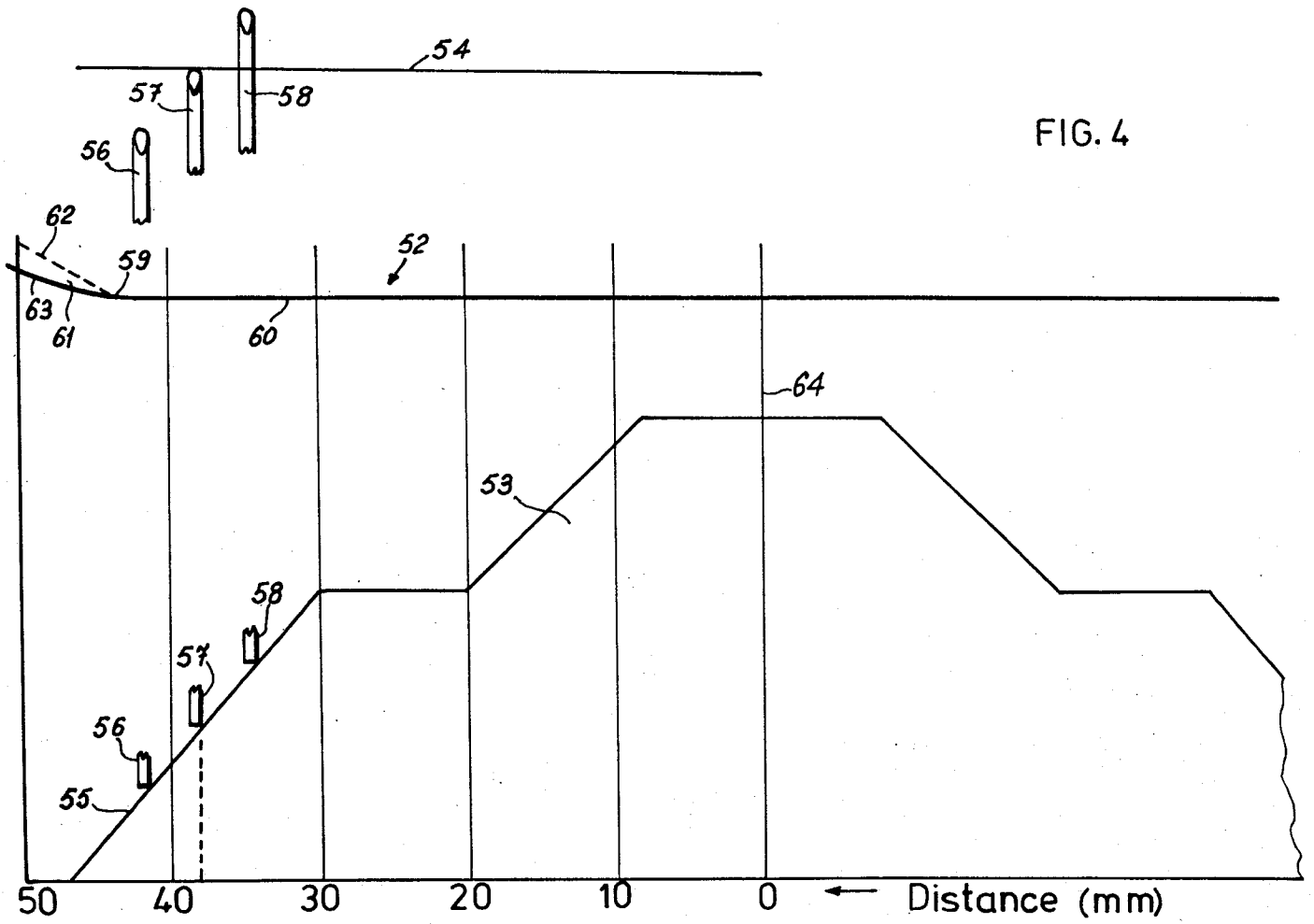
Figure 5:
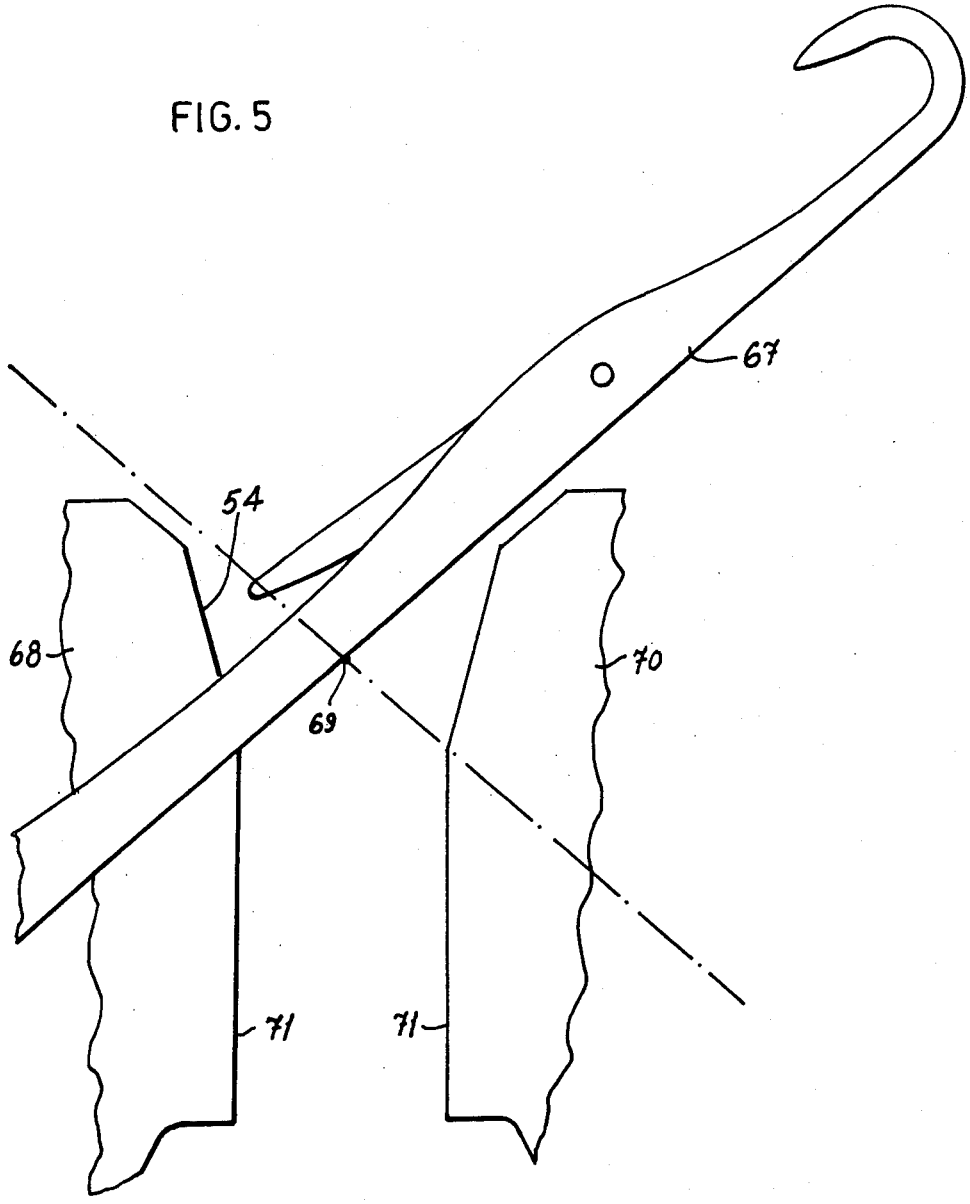
Figures 6, 8:
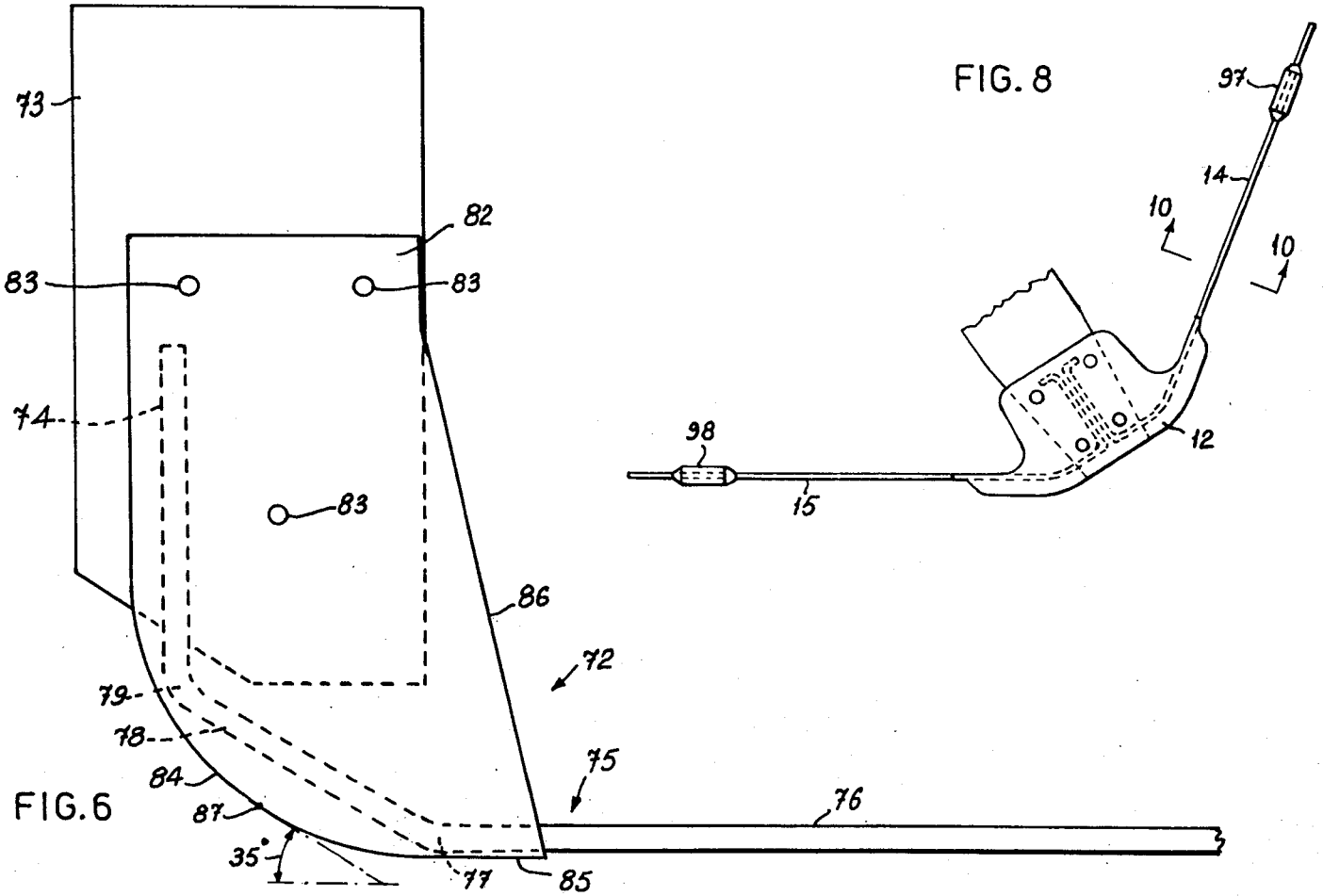
Figure 9:
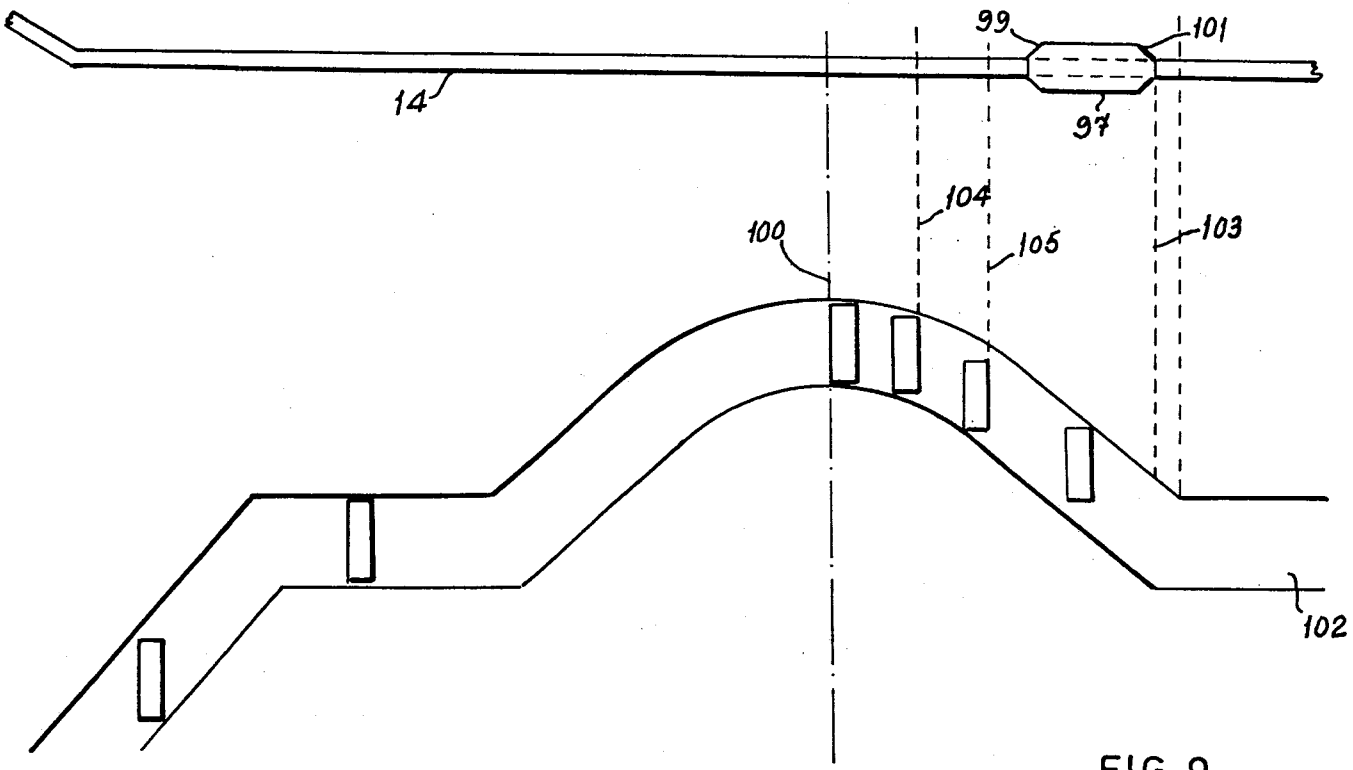
Figure 10:
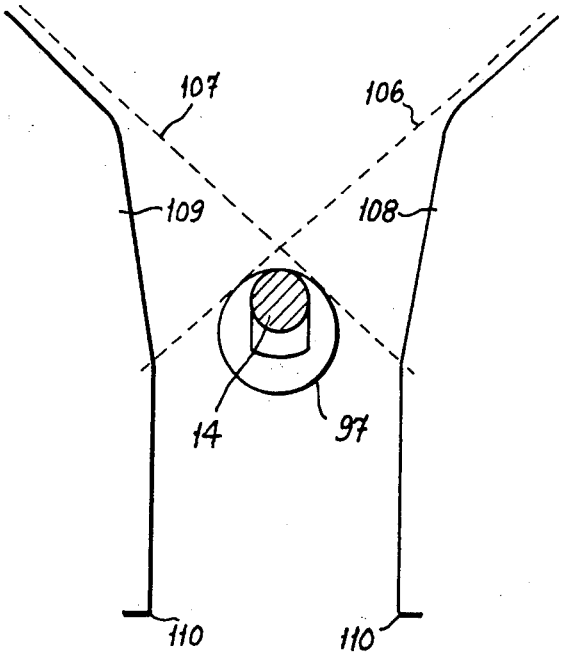

The invention will be further described, by way of example, with reference to the accompanying drawings in which:

FIG. 1 is a side view of a pair of presser feet according to the invention for a flat V-bed 5 gauge knitting machine, FIG. 2 is a view, on an enlarged scale, in the direction of the arrow II in FIG. 1, FIG. 3 is a diagram illustrating the dimensions and shape of a pair of presser feet similar to those shown in FIG. 1 but suitable for a 7 gauge knitting machine, FIG. 4 is a diagram illustrating the position of a presser foot according to FIGS. 1 and 2 or FIG. 3 in relation to the cam system with which it is to cooperate, FIG. 5 is a diagram illustrating needle movement in relation to the knocking over bits in a flat V-bed knitting machine, FIG. 6 is a side view of a single presser foot according to the invention for a flat V-bed 10 gauge knitting machine, FIG. 7 is a cross-section through a leading portion of a third presser foot according to the invention, FIG. 8 is a side view of another pair of presser feet according to the invention, FIG. 9 shows, on an enlarged scale, the location of a presser foot of FIG. 8 in relation to the cam system with which it is intended to co-operate, and FIG. 10 is a cross-section on the line 10—10 of FIG. 8, on a larger scale than FIG. 8 (and FIG. 9), showing the presser foot of FIG. 8 and parts of associated knocking-over bits.

The presser feet 10 and 11 shown in FIGS. 1 and 2 are suitable for fitting at the lower end of a supporting member (not shown) pivotally mounted on a presser foot carrier as described in British Patent Specification No. 1,288,043. Each of the presser feet 10, 11 has a leading portion comprising parts of two spaced plate-like elements 12 and 13 each of which is constituted by a thin, shaped, beryllium-copper alloy sheet. Each of the presser feet 10, 11 also has a trailing portion comprising a resilient wire 14, 15, respectively, which can be deflected upwardly, in use, by the forces applied to it by knitted loops.

Each of the elements 12, 13 comprises a central portion 16 with two sideways projecting portions 17 and 18 which extend away from the central portion in opposite directions in the region of its lower edge. The elements 12 and 13 are secured on opposite faces of a blade 19 made of a carbon fibre composite and adapted to be secured to the lower end of a supporting member (not shown) for the presser feet. The elements 12 and 13 are secured to a thickened lower part of the blade 19 by means of adhesive and are located on the blade 19 by means of studs 22 which extend through the blade and are engaged in apertures in the elements 12, 13.

Each of the wires 14, 15 has an end portion 23, 24, repsectively, embedded in the blade 19 and each wire is bent at a point just outside the blade 19 through an obtuse angle and is bent again inside the blade at right angles so that within the blade 19 each wire extends largely along the length of the blade, the extreme end portions of the wires 14 and 15 being bent at right angles to the adjacent portions of the wires which are thus "hooked over" at their ends giving a good key to the carbon fibre composite material moulded about them.

Each of the elements 12, 13 is similarly shaped. The shape of the projecting portions 18 of the two elements (which is the same as the shape of the projecting portions 17) can be seen in FIG. 2. In the trailing direction, that is in the direction to the right in FIG. 2, each projecting portion 18 first diverges from the associated wire 14, which is centrally located between the two elements 12 and 13, it then extends parallel to the wire 14 for some distance, and at its trailing end curves back towards the wire 14, the extreme end part of the projecting portion lying close to and extending parallel or substantially parallel to the wire 14.

In side view, as seen in FIG. 1, each of the elements 12, 13 comprises a smooth lower surface made up of two straight portions 26 and 27 joined by an arcuate portion 28. At the trailing end of each of its projecting portions 17, 18, each of the elements 12, 13 curves smoothly up to the extreme end part 25 of the projecting portion, this end part having an under surface at or near the level at which the wire 14 or 15 constituting the trailing portion of the corresponding presser foot extends from the leading portion of the presser foot. The leading portion of each presser foot, in the construction shown in FIGS. 1 and 2, is thus constituted by a member comprising parts of the two elements 12 and 13 and having a smooth lower surface adapted to contact knitted loops, the surface being constituted by parts of the lower edges of the elements 12 and 13, these elements being spaced from one another as can be seen from FIG. 2. Said smooth lower surface of the leading portion of each presser foot, as can be seen in FIG. 1 in relation to the presser foot 11, has a forward part 31 which is higher than a rearward part 32 of the surface, the surface part 31 being downwardly and rearwardly inclined and having a smooth transition with the surface part 32.

The leading portion of each presser foot of FIG. 1, being constituted by parts of two plate-like elements, is stiff and able to resist forces applied to it in the planes of the two elements and since the presser foot, when in use, pushes down on knitted loops with the member constituting its leading portion and the knitted loops respond by exerting forces on the member in the planes, or approximately in the planes of its plate-like elements, said member is well adapted to resist deformation by the forces applied to it by knitted loops.

The shape of the lower edges of the elements 12 and 13 ensures that the section of the forward part 31 of said edges which, in use, first contacts the knitting is inclined to the direction of relative movement between the presser foot and the knitting machine needles at an angle less than 35°. This will be explained below in greater detail with reference to FIG. 3.

FIG. 3 shows parts of two presser feet 35 and 36 carried by a blade 37 of carbon fibre composite material which is adapted to be secured on the lower end of a pivoted supporting member (not shown). A separate plate-like element 38 is secured to each face of the lower part of the blade 37 by means of adhesive and the two elements 38 are located on the blade by means of studs 39 engaged in apertures in elements 38 and extending through the blade 37. Parts of the two elements 38 constitute a leading portion of the presser foot 35 and parts constitute a leading portion of the presser foot 36.

A trailing portion 40 or 41 of each presser foot is constituted by a part of a resilient wire 42, a central portion 43 of which is embedded in the lower end of the blade 37.

The presser foot 36 is shown in FIG. 3 in its operative position in which it cooperates in the knitting action and the trailing portion 41 is shown in its undeflected position and is horizontal. The central portion 43 is inclined forwardly and upwardly of the trailing portion 41 at an angle of 35° (in relation to a direction of movement of the presser foot 41 from right to left in FIG. 3 which corresponds to operation of the presser foot 41). The trailing portion 40 is disposed in relation to the central portion 43 in a similar way to the trailing portion 41 so that when the trailing portion 40 is in its undeflected operative position the central portion 43 is inclined forwardly and upwardly of the trailing portion 41 at an angle of 35° (in relation to a direction of movement of the presser feet 40 and 41 from left to right in FIG. 3 which corresponds to operation of the presser foot 40).

The bend 44 between the trailing portion 41 and the central portion 43 marks the transition between the leading portion of the presser foot 36 and the trailing portion 41 of the presser foot. This bend is located just in advance of the position at which the cam system associated with the presser foot 36 has raised the needles to the "fleur le jack" position, that is the position at which the heads of the needles are just level with the knocking over bits so that any further rise of the needles causes them to extend above the space between the knocking over bits of the two beds, towards their crosssing-over point with the needles of the other bed.

The function of the trailing portion 41 is to hold down the knitted loops on the needles if these loops show any tendency to rise as the needles are raised. The function of the leading portion of the presser foot 36 is to push down the knitted loops on the needles if these loops have risen above the level of the trailing portion 41. The action of the leading portion of the presser foot on the knitted loops should be a gentle one and for this purpose it has a smooth under surface constituted by parts of the lower edges 46 of the elements 38. The knitted loops are intended to contact each element 38 at a point 45 below the central point 47 of the lower edge 46 of the elements. The lower edge 46 of each element 38 is an arc of a circle with, in this case, a radius of 34 mm, the centre of the arc lying on the centre line 48 of the blade 37. At the bend 44, a horizontal line is tangential to each lower edge 46 and the tangent to each lower edge 46 at its centre point forms an angle of 35° with the horizontal so that at the point 45, the highest point of each element 38 which contacts knitted loops, each lower edge 46 is inclined to the direction of relative movement between machine needles and presser foot, a horizontal line in FIG. 3, at an angle less than 35°.

The presser foot device shown in FIG. 3 is symmetrical about the line 48 and the part of each lower edge 46 associated with the presser foot 35 has the same configuration and occupies a similar position in relation to the knitted loops, when in the operative position, as the part of the lower edge 46 associated with the presser foot 36. The bend 44 at the end of the trailing portion 41 and the corresponding bend 49 at the end of the trailing portion 40 are spaced apart a distance corresponding to the spacing of the cam systems with which the two presser feet 35 and 36 are intended to cooperate. The positioning of a presser foot 52 in relation to a cam system 53 of a knitting machine is illustrated diagrammatically in FIG. 4. The relative direction of movement of the needles in relation to the cam system 53 is from left to right in FIG. 4 and three needles are illustrated in three different positions. In each case, the head of the needle is shown in relation to a line 54 through edges of the knocking over bits in the machine at the level at which the needle heads emerge from between the knocking over bits, (see FIG. 5). The butt of each needle (given the same reference numeral as the head) is shown in relation to the raising cam 55 of the cam system 53. The needle 56 is positioned just in advance (2 or 3 mm in advance) of the "fleur le jack" position occupied by the needle 57, that is the position at which the head of the needle is just flush with the line 54 through the edges of the knocking over bits. The needle 58 is 2 or 3 mm past the "fleur le jack" position. The junction 59 between the horizontal trailing portion 60 of the presser foot 52 and the leading portion 61, which begins to curve upwardly from this junction, is located a little in advance of the "fleur le jack" position, 3 to 5 mm in advance in the present instance. The trailing portion 60 may be constituted by a resilient wire which continues into the leading portion 61 of the presser foot where the wire is mounted, as in the presser feet of FIGS. 1 and 2 and FIG. 3. The forward portion 62 of the wire may follow the broken line shown within the leading portion 61 and the bend in the wire may be at the junction 59. In such a construction it is desirable that the lower surfaces 63 of the leading portion 61 should protect the forward portion 62 of the wire and bear the brunt of each impact of the presser foot with the knitted loops held on the needles of the knitting machine. In this way, the mounting for the wire of which the trailing portion 60 is constituted is relieved of stresses which can cause fatigue failures in the mounting.

In FIG. 4, the centre line 64 of the cam system 53 is marked and the horizontal scale shows distances from this centre line.

The presser foot device shown in FIGS. 1 and 2 is similar to that shown in FIG. 4 and the leading portion of each presser foot in these devices serves the same purpose of protecting the wire of the trailing portion and its mounting from the shock of initial impact of the presser foot with the knitted loops as the foot moves relatively to the needles. The rearmost stitch contacting section of the leading portion of each presser foot in FIG. 4 is the rearmost section of the presser foot and the trailing portion 40 or 41 is located approximately 1 mm above this rearmost section at the point where the trailing portion extends rearwardly from the rearmost section of the leading portion. In the presser foot device of FIGS. 1 and 2, the rearmost stitch-contacting section of each leading portion is constituted by the rearmost section of the straight portion 26 or 27 of the element 12 or 13, respectively, these sections being just in advance of the extreme end part 25 of the corresponding sideways projecting portion 17 or 18 of the elements 12 and 13 which, together with the trailing portion 14 or 15, is at a height of 3 or 4 mm above the straight portion 26 or 27 of the lower surfaces of the elements 12 and 13. Of course knitted loops may touch the extreme end parts 25 but these parts do not have any effective contact with knitted loops so as to control them during the knitting operation.

FIG. 5 illustrates the movement of a needle 67 in relation to the knocking over bits in a flat V-bed knitting machine and shows the position of the line 54 of FIG. 4 in relation to the knocking over bits 68 of one needle bed. The crossing point 69 of the needles of the two beds is shown.

The lower surface of each of the knocking over bits 68 and 70 extends outwardly at right angles to the vertical inner edge 71 of the knocking over bit before extending outwardly and downwardly. This produces a widened "throat" between the knocking over bits into which the downwardly moving knitted fabric can expand. The sharp (right angle) corner makes it difficult for the fabric to move back up between the beds and thus has a restraining effect on the fabric.

The presser foot 72 shown in FIG. 6 is carried on a metal plate 73. An end portion 74 of a wire 75 is located in a bore in the plate 73 and part of the wire constitutes a horizontal trailing portion 76 of the presser foot. The wire 75 is bent at 77 between the trailing portion 76 and a portion 78 inclined at 35° to the horizontal (in position of use). The wire is bent again at 79 between the portion 78 and the end portion 74. The portion 78 of the wire 75 is protected by two plate-like elements 82 secured to opposite faces of the plate 73 by rivets 83. The forward and lower surfaces of each element 82 comprise a smoothly arcuate portion 84 which curves downwardly and rearwardly to make a smooth transition into a straight portion 85 lying approximately 1 mm below and parallel to the trailing portion 76. The location of the bend 77 in this instance is further forward in relation to the cam system with which the presser foot 72 cooperates than is the case with the presser foot 52 of FIG. 4. This forward shift of the presser foot is possible in the construction of FIG. 6 because the plate 73 is intended to be slidably mounted on the cam box of the knitting machine to enable the presser foot to slide down into operative position and slide up again into the inoperative position. The movement of the presser foot between operative and inoperative positions does not therefore impose any constraints on the geometry of the construction as is the case with a pivotally mounted presser foot as shown in FIGS. 1 and 2 or FIG. 3, the geometry of which is illustrated in FIG. 4. The elements 82 in FIG. 6 have a shape which provides no sideways projecting portions, such as the portions 17 and 18 in FIG. 1, but instead has a steeply rising rear edge 86. The elements 82 must therefore not extend rearwardly so far that the rising needles would collide with them, and in practice they should terminate at or in advance of the "fleur le jack" position (the position of needle 57 in FIG. 4). The elements 82 are intended to contact knitted loops at a level below the point 87 at which the tangents to the arcuate portions 84 make an angle of 35° to the horizontal. The inclination of these portions to the direction of relative movement of presser foot and needles (a horizontal direction) at the point of contact with the knitted loops is thus less than 35°.

FIG. 7 is a cross-section of another presser foot 89 according to the invention having a stiff leading portion 90 which is approximately triangular in cross-section with a rounded lower edge 91. The leading portion 90 is curved so that its lower edge 91 follows the same contour as the arcuate portion 84 and the straight portion 85 of the foward and lower surfaces of the element 82 of FIG. 6. From the trailing end of the leading portion 90 extends a horizontal wire trailing portion 92 located in a bore in the leading portion. The trailing portion 92 is resilient and can be deflected in an upward direction by the forces applied by knitted loops. The trailing portion 92, in its undeflected condition is located approximately 4 mm above the trailing end of the lower stitch-contacting edge 91 of the leading portion 90.

The forward end 93 of the leading portion 90 merges into a plate 94 enabling the presser foot 89 to be slidably mounted on a V-flat knitting machine for movement into and out of an operative position.

Each presser foot in FIG. 8 has a leading portion comprising parts of two spaced plate-like elements 12 and 13, shaped, mounted and located in the same manner as the elements 12 and 13 of FIGS. 1 and 2, like reference numerals being used for like parts in FIG. 8 and in FIGS. 1 and 2. Each presser foot in FIG. 8 also has a thin elongate trailing portion comprising a resilient wire 14 or 15. On each of the wires 14, 15 is soldered a piece of circular section tube 97, 98, respectively, through which the wire 14, 15 extends. The length of each of the tubes 97, 98 is approximately equal to one needle pitch of the machine, in the case of a machine of E7 gauge, approximately 3.6 mm. The diameter of each of the tubes 97, 98 is preferably at least twice the diameter of the wires 14, 15 and in the present example, for E7 gauge, its external diameter is 2.1 mm and it is secured on the wire 14 or 15 so that the axis of the wire coincides with that of the tube.

The solder securing each of the tubes 97, 98 to the corresponding wire 14 or 15 is shaped to give smoothly curving joints between the tube and the corresponding wire. Thus each soldered tube has the form of a swelling on the corresponding wire which merges smoothly with the wire in the forward and rearward directions. The swelling, which may be referred to as a protuberance or slug and including the tapering portions at each end has an overall length of approximately 5 mm, extends in each of three dimensions from the wire 14 or 15. It is desirable that when the wire is in attitude the protuberance should extend at least to both sides of the wire and downwardly.

FIG. 9 illustrates the position in which the tube 97 or 98 is located, in use, in relation to the cam system with which it is arranged to cooperate. The forward end 99 of the tube 97 shown in FIG. 9 is situated to the rear of the location 100 at which the needles are in their highest position and the rearward end 101 of the tube 97 is situated in advance of the location where the needles take yarn into their hooks. In the cam system shown in FIG. 9, each needle takes yarn whilst the needle butt is located on the flat portion 102 of the cam profile and the rearward end 101 of the tube 97 is situated in advance of the point where the needle butts reach this flat portion, that is in advance of the location where the descending needles first reach the height at which each needle grasps new yarn in its hook. Preferably, the rear end of the tube 97 is situated in advance of the point 103 where the latch spoon of a descending needle enters between the knocking over bits of the machine so that the tube 97 acts to tension the yarn associated with the descending needles in the region where the loops on the needle shanks are in process of moving beneath the needle latches preparatory to being cast off. Preferably, to avoid restricting the flexibility of the wire 14 too much and preventing the wire 14 moving up into the "tent" formed by the raised needles, the forward end 99 of the tube 97 is located to the rear of the position 104 at which the needles start to descend. Advantageously, the forward end 99 of the tube 97 is located to the rear of the position 105 where the needle has descended by an amount equal to the diameter of the tube 97 (2 mm in the present case).

FIG. 10, which is a rearward view from the line 10—10 in FIG. 8 on an enlarged scale, shows the position of the tube 97 and of the wire 14 in relation to the under-surfaces 106 and 107 of raised needles. In use, the wire 14 curves downwardly and rearwardly from an upper location at the position of the line 10—10 (FIG. 8) to a lower location at the position of needle cross-over, to which it is forced by the tube 97 impinging on the needle undersurfaces 106 and 107.

FIG. 10 also shows the location of the wire 14 and the tube 97 in relation to knocking-over bits 108 and 109 with right-angle lower corners 110 which act to restrain the fabric pushed down between the beds against rising again as the needles are raised.

What is claimed is:

1. A knitting machine with independently operable needles located in opposed needle beds and comprising:

a presser foot device including at least one presser foot for controlling loops during the knitting procedure, said presser foot having a leading portion and a trailing portion in relation to a direction of movement relative to needles of the machine, said leading portion comprising a stitch contacting member operative close to both needle beds and stiff so as to resist deformation by knitted loops whereby said member will contact and control knitted loops held on needles of both needle beds, said member including a stitch contacting surface close to both needle beds, said stitch contacting surface being smoothly curved downwardly and rearwardly in the direction of said relative movement and having a forward part which is first to contact knitted loops in operation of said presser foot, said forward part of said stitch contacting surface being inclined to the direction of said relative movement at an angle less than 35°, said presser foot including a junction region between downward inclination of said stitch contacting surface of said stitch contacting member and rearward extension of said presser foot in said direction of relative movement, said junction region being located in advance of flush jack position in said knitting machine, and said trailing portion of the presser foot comprising a resilient elongated element mounted rigid with said leading portion and extending rearwardly therefrom.

2. A presser foot device for a knitting machine with independently operable needles located in opposed needle beds, said device comprising:

a leading portion and a trailing portion in relation to a direction of movement relative to needles of the machine, said leading portion comprising two plate-like elements each operative close to a needle bed to contact and control knitted loops held on needles of said bed and including a stitch contacting surface.

the stitch contacting surfaces of each of said plate-like elements being smoothly curved downwardly and rearwardly in the direction of said relative movement and having a forward part which is first to contact knitted loops in operation of said presser foot and is inclined to said direction of relative movement at an angle less than 35°, a blade of reinforced composite material, said plate-like elements being secured one on each surface of said blade with said stitch contacting surface extending below said blade in each case, said trailing portion of said presser foot being constituted by a resilient elongated element embedded in said reinforced composite material so as to be rigid with said plate-like elements and extending therefrom, said presser foot including a junction region between downward inclination of said stitch contacting surface of each said stitch contacting member and rearward extension of said presser foot in said direction of relative movement, and said junction region being located in advance of the flush jack position in operative mode of said presser foot.

3. A presser foot for a knitting machine having independently operable needles located in opposed needle beds, the presser foot having (a) a leading portion comprising a member with a smooth surface adapted to contact knitted loops when the presser foot is in use, the forward part of said surface being higher than the rearward part and the two parts having a smooth transition between them, said member being adapted to resist deformation by the forces applied by knitted loops and being so shaped that the inclination of the forward part of said surface which first contacts the knitted loops during relative movement of machine needles and presser foot, in use, is inclined to the direction of said relative movement at an angle less than 35°, and (b) a trailing portion comprising a thin elongated element extending rearwardly from said leading portion and being, at the location where it departs from the leading portion, at a level substantially the same as or higher than the level of the rearmost stitch contacting section of said leading portion, said trailing portion being adapted to be resiliently deflected in an upward direction by the forces applied to it, in use, by knitted loops and wherein (c) said trailing portion is long enough to extend rearwardly from a location in the region of the flush jack position of needles in a knitting machine to a location in the associated region where the needles descend again to the flush jack height, said trailing portion having a protuberant portion intended to be located in the region of the descending path of the needles, between the location at which the needles are in their highest position and the location where the needles take new yarn into their hooks and serving to tension yarn extending between the opposed needle beds so that the loops of yarn on the needle shanks are held close to the shanks and are less likely to be impaled by the latches of the descending needles.

4. A presser foot for a knitting machine having independently operable needles located in opposed needle beds, said presser foot including (a) a leading portion, and (b) a thin elongated trailing portion long enough to extend rearwardly from said leading portion of the presser foot, from a locaton in the region of the flush jack position of the needles of a knitting machine to a location in the region where the needles descend again to the flush jack height, (c) said trailing portion having a protuberant portion located in the region of the descending path of the needles between the location at which the needles are in their highest position and the location where the needles take new yarn into their hooks, said protuberant portion serving to tension yarn extending between the opposed needle beds so that the loops of yarn on the needle shanks are held close to the shanks and are less likely to be impaled by the latches of the descending needles.

5. A presser foot for a knitting machine as claimed in claim 4, wherein said protuberant portion terminates in advance of the location where the latch spoon enters between knocking over bits of the machine.

6. A presser foot for a knitting machine as claimed in claim 5, wherein the protuberant portion protrudes in three dimensions.

7. A presser foot for a knitting machine as claimed in claim 6, wherein said protuberant portion is constituted by a tube through which said trailing element extends, the join between the two constituting a smoothly curved transition.

* * * * *